United States Patent [19]

Tobias et al.

[11] Patent Number: 4,982,460

[45] Date of Patent: Jan. 8, 1991

[54] FLOW ENHANCING JET FITTING

[75] Inventors: Samuel Tobias, Edison; William E. Treene, Upper Montclair; George E. Williams, Boonton, all of N.J.

[73] Assignee: Hayward Industries, Inc., Elizabeth, N.J.

[21] Appl. No.: 329,653

[22] Filed: Mar. 28, 1989

Related U.S. Application Data

[63] Continuation-in-part of Ser. No. 222,209, Jul. 21, 1988, abandoned.

[51] Int. Cl.[5] ..... A61H 33/00

[52] U.S. Cl. ..... 4/542; 4/541; 4/492; 128/66; 239/428.5

[58] Field of Search ..... 4/492, 541, 542, 544, 4/545; 239/428, 428.5; 128/66, 203.5; 417/151, 174

[56] References Cited

U.S. PATENT DOCUMENTS

| | | | |
|---|---|---|---|
| 2,642,813 | 6/1953 | Woodruff et al. | 417/185 |
| 3,003,521 | 10/1961 | Colonna | 417/151 |
| 3,129,874 | 4/1964 | Mittelstaedt | 417/151 |
| 3,273,560 | 9/1966 | Jacuzzi | 4/559 |
| 3,287,741 | 11/1966 | Nash | 4/544 |
| 3,297,025 | 1/1967 | Jacuzzi | 128/66 |
| 3,336,921 | 8/1967 | Lloyd | 128/66 |
| 3,345,982 | 10/1967 | Guiler | 128/66 |
| 3,391,870 | 7/1968 | Nash | 4/559 |
| 3,396,722 | 8/1968 | Lindberg | 128/66 |
| 3,471,091 | 10/1969 | Baker | 239/416 |
| 3,504,702 | 4/1970 | Collins et al. | 137/369 |
| 3,540,438 | 11/1970 | Jacuzzi | 128/66 |
| 3,541,616 | 11/1970 | Stricker | 128/66 |
| 3,565,091 | 2/1971 | Auger | 417/174 |
| 3,605,131 | 9/1971 | Brazel et al. | 4/491 |
| 3,614,952 | 10/1971 | Agnellino | 128/66 |
| 3,745,994 | 7/1973 | Kane | 128/66 |
| 3,890,655 | 6/1975 | Mathis | 128/66 |
| 3,890,656 | 6/1975 | Mathis | 128/66 |
| 3,905,358 | 9/1975 | Jacuzzi | 128/66 |
| 3,946,449 | 3/1976 | Mathis | 128/66 |
| 3,977,027 | 8/1976 | Speck | 128/66 |
| 4,082,091 | 4/1978 | Raab | 128/66 |
| 4,168,705 | 9/1979 | Raab | 128/66 |
| 4,220,145 | 9/1980 | Stamp et al. | 128/66 |
| 4,221,336 | 9/1980 | Diamond | 239/428.5 |
| 4,240,166 | 12/1980 | Altman et al. | 4/542 |
| 4,261,347 | 4/1981 | Spencer, III et al. | 128/66 |
| 4,262,371 | 4/1981 | Berry et al. | 4/492 |
| 4,264,039 | 4/1981 | Moreland | 239/428.5 |
| 4,335,854 | 6/1982 | Reynosso | 239/428.5 |
| 4,339,833 | 7/1982 | Mandell | 4/542 |
| 4,349,923 | 9/1982 | Chalberg | 4/542 |
| 4,358,862 | 11/1982 | Altman et al. | 4/542 |
| 4,379,097 | 4/1983 | Leggett | 4/542 |
| 4,402,094 | 9/1983 | Sanders | 4/504 |
| 4,416,030 | 11/1983 | Reynoso | 239/428.5 |
| 4,420,846 | 12/1983 | Bonner | 4/541 |
| 4,422,191 | 12/1983 | Jaworski | 4/496 |
| 4,442,045 | 4/1984 | Sciolla | 239/428.5 |
| 4,460,519 | 7/1984 | Leggett | 4/542 |
| 4,466,141 | 8/1984 | Starkey | 4/492 |
| 4,501,659 | 2/1985 | Henk | 210/164 |
| 4,502,168 | 3/1985 | Jaworski | 4/496 |
| 4,508,665 | 4/1985 | Spinnett | 4/542 |
| 4,520,514 | 6/1985 | Johnson | 4/492 |
| 4,523,340 | 6/1985 | Watkins | 4/542 |
| 4,525,881 | 7/1985 | Higginbotham | 4/496 |
| 4,537,358 | 8/1985 | Anderson | 239/428.5 |
| 4,541,780 | 9/1985 | Moreland | 4/542 |
| 4,542,853 | 9/1985 | Diamond | 239/428.5 |
| 4,542,854 | 9/1985 | Mathis | 4/542 |
| 4,593,420 | 6/1986 | Tobias et al. | 4/492 |
| 4,671,463 | 6/1987 | Moreland et al. | 4/542 |
| 4,679,258 | 7/1987 | Henkin et al. | 4/542 |
| 4,689,839 | 9/1987 | Henkin et al. | 4/542 |
| 4,715,071 | 12/1987 | Henkin et al. | 4/542 |
| 4,731,887 | 3/1988 | Henkin et al. | 4/542 |
| 4,742,965 | 5/1988 | Messinger et al. | 239/417.3 |
| 4,813,086 | 3/1989 | Henkin et al. | 4/542 |
| 4,853,987 | 8/1989 | Jaworski | 4/592 |

*Primary Examiner*—Henry J. Recla

*Assistant Examiner*—Edward C. Donovan

*Attorney, Agent, or Firm*—Ralph W. Selitto, Jr.

[57] ABSTRACT

A jet fitting for a hydrotherapeutic receptacle includes an internal chamber which functions as a mixing chamber as well as a suction chamber. A primary stream of water is supplied to the mixing chamber in such a manner that a low pressure condition is created within the mixing chamber for entraining a secondary stream of water which flows from the hydrotherapeutic receptacle to the mixing chamber and for entraining air from an outside source.

14 Claims, 3 Drawing Sheets

FLOW ENHANCING JET FITTING

CROSS-REFERENCE TO RELATED APPLICATION

This application is a continuation-in-part of pending U.S. patent application Ser. No. 222,209, now abandoned filed July 21, 1988.

FIELD OF THE INVENTION

The present invention relates to jet fittings for hydrotherapeutic receptacles, such as bathtubs, spas and therapy tanks, and, more particularly, to such fittings which are adapted to enhance the flow of water discharged therefrom.

BACKGROUND OF THE INVENTION

Whirlpool-type baths have long been the mainstay of athletic training rooms and physical therapy facilities. These baths are used to treat discomfort resulting from strained muscles, joint ailments and the like. The agitating motion of the warm bath water relieves the soreness and promotes tissue regeneration by increasing the flow of blood to the area of the injury. More recently, whirlpools have been found in increasing numbers in health spas and homes as they have gained in popularity as a means of relaxing from the daily stresses of modern life. The bubbling water and swirling jet streams create an invigorating motion that massages the user's body.

To create the desired whirlpool motion and hydromassage effect, jet fittings are typically employed to inject water into the receptacle at a high velocity. In the past, it has been proposed to enhance the whirlpool motion by adapting the fitting to increase the circulation of the water within the receptacle. Henkin et al. U.S. Pat. No. 4,689,839 discloses such a fitting where water is drawn from the receptacle and mixed with the inlet stream in a mixing chamber located externally of the receptacle and remote from the fitting itself. A major drawback of the fitting disclosed in the Henkin patent involves the extra plumbing required to convey water to and from the mixing chamber.

Henk U.S. Pat. No. 4,501,659 discloses a skimmer apparatus for a conventional swimming pool which enhances the skimming operation by increasing the flow therethrough. The apparatus operates solely within the pool. Flow is increased by using the output from a pool filter as an ejector. More particularly, filtered water is directed into a venturi, which entrains the surrounding pool water and discharges the resulting combined stream into the pool. Although the skimmer apparatus of the Henk patent effectively enhances the flow of pool water, its utility is limited to the performance of a skimming operation.

Henkin et al. U.S. Pat. No. 4,731,887 discloses a hydrotherapy jet assembly which is suitable for mounting in a wall of a spa, bathtub or the like. The jet assembly includes a mixing chamber which is supplied with water under pressure by a water jet nozzle. A passageway extends internally through the assembly between the mixing chamber and the spa or tub so that water can be drawn from the spa or tub for entrainment by the water jet. Thus, the stream discharged from the jet assembly into the spa or tub includes the following components: (i) water supplied under pressure into the mixing chamber by the water jet nozzle; and (ii) water drawn or aspirated from the spa or tub for entrainment by the water jet.

The jet assembly disclosed in the Henkin et al. '887 patent can be adapted to draw or aspirate air, as well as spa or tub water, into the mixing chamber. However, in such an adaptation, it is difficult to strike a suitable balance between the amount of aspirated spa or tub water, on the one hand, and the amount of aspirated air, on the other hand, due to the fact that an increase in the quantity of aspirated spa or tub water results in a decrease in the quantity of aspirated air and vice versa. Thus, in order to ensure that the jet nozzle can create a water flow having a velocity which is high enough to entrain both air and spa or tub water, the jet assembly of the Henkin et al. '887 patent is limited to relatively low flow rate requirements and to relatively small nozzles. A delicate balance therefore exists between the size of the passageway for the entrained spa or tub water and the flow rate, which is a function of the size of the jet nozzle, required to make the assembly functional. If built in a larger size for use with a standard size pump typically employed in the hydrotherapy industry, the jet assembly disclosed in he Henkin et al. '887 patent would not work properly, if at all.

SUMMARY OF THE INVENTION

In accordance with the present invention, a jet fitting for a hydrotherapeutic receptacle includes a mixing chamber which is located internally of the fitting and which communicates with a pair of water inlets: one of which functions as a main inlet to provide communication between the mixing chamber and a source of pressurized water and the other which functions as an auxiliary inlet to provide communication between the mixing chamber and the hydrotherapeutic receptacle. The main inlet is provided with a nozzle throat designed to increase the velocity of the water being discharged into the mixing chamber from the main inlet and thereby create a low pressure condition within the mixing chamber. This low pressure condition, in turn, causes a "jet pump" effect which results (i) in water from the hydrotherapeutic receptacle being sucked into the mixing chamber through the auxiliary inlet and (ii) in air being sucked into the mixing chamber through an air supply tube which is open to the atmosphere. The water entering the mixing chamber through the auxiliary inlet and the air entering the mixing chamber through the air supply tube mix with the water entering the mixing chamber through the main inlet and the resulting combined water/air stream is then discharged into the hydrotherapeutic receptacle through, for instance, a directional nozzle.

By locating an outlet end of the air supply tube in the center of the stream of water exiting the main inlet to the mixing chamber (i.e., the stream of water passing through the nozzle throat), the water of such stream is forced to flow around the air supply tube, thereby increasing its velocity and creating a further low pressure zone in the mixing chamber adjacent to the throat of the nozzle. The creation of such a further low pressure zone enhances the entrainment of air in smaller size fittings and makes air entrainment possible in larger size fittings without significantly impairing the entrainment of water from the hydrotherapeutic receptacle.

By utilizing the "jet pump" effect described above, the present invention also permits the discharge rate of the jet fitting to be increased (as much as 50% and even more) without increasing the capacity of a pump or similar device employed to supply the pressurized water to the fitting. Such an increase in the discharge rate results in improved circulation of the water in the hydrotherapeutic receptacle, as well as enhanced whirlpool motion and hydromassage effect. The present invention may also permit a reduction in the number of fittings required to achieve the desired whirlpool motion and hydromassage effect.

BRIEF DESCRIPTION OF THE DRAWINGS

For a better understanding of the present invention, reference is made to the following description of two exemplary embodiments considered in conjunction with the accompanying drawings, in which.

DESCRIPTION OF THE EXEMPLARY EMBODIMENTS

Figure 1:
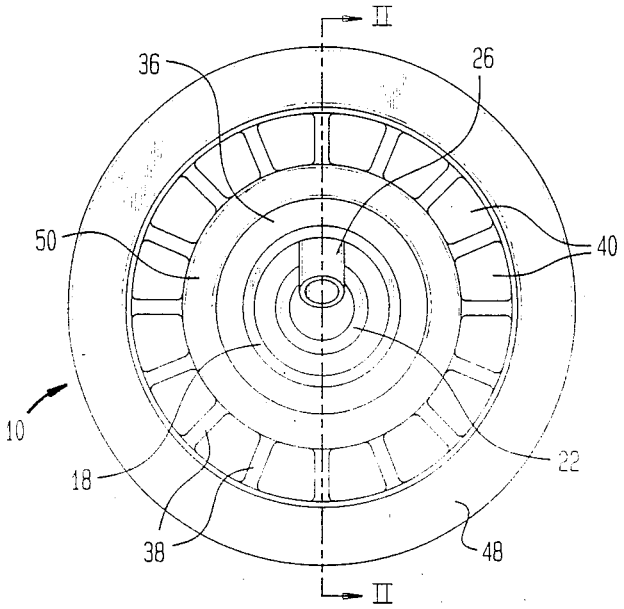
FIG. 1 is a front view of a jet fitting constructed in accordance with one exemplary embodiment of the present invention.
Figure 2:
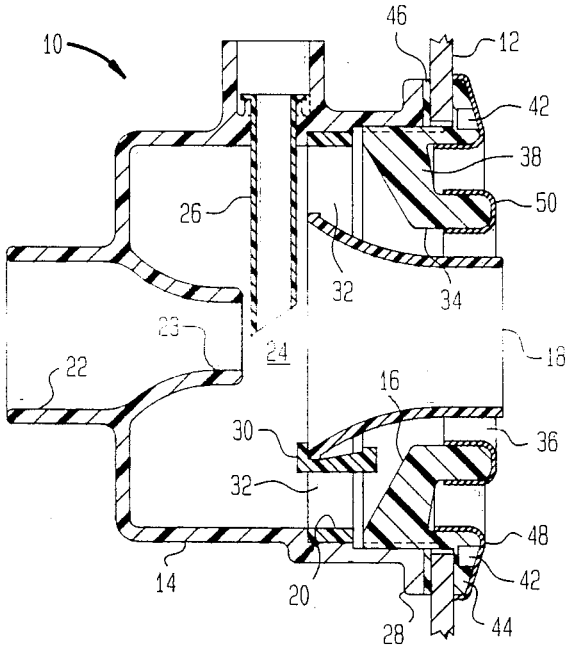
FIG. 2 is a cross-sectional view, taken along section line II—II and looking in the direction of the arrows, of the jet fitting illustrated in FIG. 1.
Figure 3:
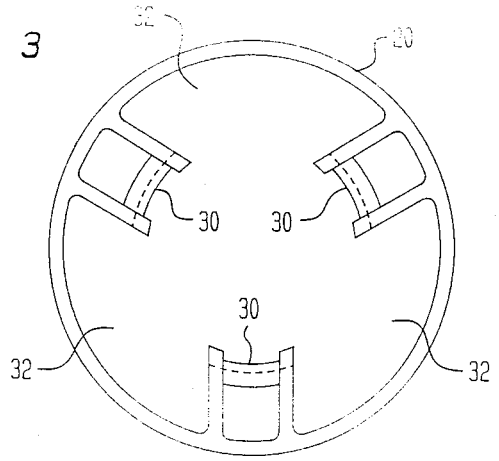
FIG. 3 is a front elevational view of a mounting ring employed by the jet fitting of FIGS. 1 and 2.

Referring to FIGS. 1–3, a jet fitting 10 is attached to a sidewall 12 of a hydrotherapeutic receptacle, such as a bathtub, spa or therapy tank. The jet fitting 10 includes the following main components: a body 14, a bulkhead fitting 16, a directional nozzle 18 and a mounting ring 20, all of which are preferably made out of a suitable polymeric material.

The body 14 includes an inlet 22 which is adapted for connection to a source of water, such as a pump (not shown) which typically forms a part of a filtration and circulation system for the water contained in the hydrotherapeutic receptacle. The inlet 22 includes a nozzle throat 23 having a shape selected so as to achieve a desired effect which will be described hereinafter. The nozzle throat 23 communicates with a mixing chamber 24 located within the body 14 of the jet fitting 10. A removable air supply tube 26, having an outlet end 27, extends into the mixing chamber 24 for a purpose which will be described hereinafter. The body 14 further includes a flange 28 whose function will also be described hereinafter.

The mounting ring 20 is permanently or removably positioned within the body 14 and includes capturing prongs 30 which hold the directional nozzle 18 such that the directional nozzle 18 can be pivoted and rotated in order to direct the flow of the water being discharged therefrom. The directional nozzle 18 may be permanently or removably captured by the prongs 30, which are spaced apart so as to form channels 32 between the mounting ring 20 and the directional nozzle 18. The channels 32 are provided for a purpose which will become evident when the operation of the jet fitting 10 is described hereinafter.

The bulkhead fitting 16, which is substantially circular in shape, has a central opening 34 sized and shaped so as to receive the directional nozzle 18 in such a manner that an annular gap 36 is formed between the bulkhead fitting 16 and the directional nozzle 18. The function of the annular gap 36 will be described hereinafter. The bulkhead fitting 16 includes ribs 38 between which are formed openings 40 whose function will also be described hereinafter. External threads (not shown) on the bulkhead fitting 16 cooperate with internal threads (not shown) on the body 14 to threadedly connect the body 14 to the bulkhead fitting 16, such a threaded connection being facilitated by holes 42 adapted to receive a suitable tool for rotating the bulkhead fitting 16 relative to the body 14 during the installation of the jet fitting 10. After the jet fitting 10 has been properly installed, a flange 44 on the bulkhead fitting 16 cooperates with the flange 28 on the body 14 to clamp the jet fitting 10 in place on the sidewall 12 of the hydrotherapeutic receptacle. A gasket 46 is interposed between the flange 28 and the sidewall 12 to inhibit the leakage of water from the hydrotherapeutic receptacle. Metallic escutheons 48, 50 are permanently or removably mounted on the bulkhead fitting 16 for decorative purposes.

During the operation of the jet fitting 10, a primary stream of water from, for instance, a pump (not shown) is supplied under pressure to the mixing chamber 24 through the nozzle throat 23 of the inlet 22. From the mixing chamber 24, the primary stream of water flows into the nozzle 18, from where it is discharged into the hydrotherapeutic receptacle. The shape of the nozzle throat 23 increases the velocity of the water being discharged into the mixing chamber 24, thereby creating a low pressure condition within the mixing chamber 24. This low pressure condition, in turn, causes a "jet pump" effect which results in air being sucked into the mixing chamber 24 through the air supply tube 26 and in a secondary stream of water being sucked into the mixing chamber 24 from the hydrotherapeutic receptacle, the secondary stream of water flowing through the gap 36, the openings 40 and the channels 32. The resulting water/air stream flows from the mixing chamber 24 into the directional nozzle and then into the hydrotherapeutic receptacle, where it creates the desired whirlpool action and hydromassage effect.

By locating the outlet end 27 of the air supply tube 26 in the center of the primary stream of water, such water is forced to flow around the air supply tube 26, thereby increasing its velocity and creating a further low pressure zone in the mixing chamber 24 adjacent to the nozzle throat 23. The creation of such a further low pressure zone enhances the entrainment of the air which is being sucked into the mixing chamber 24 through the air supply tube 26, which is normally open to the atmosphere. The creation of this further low pressure zone is promoted by the oblique shape of the outlet end 27 of the air supply tube 26. If the air supply tube 26 is removed, no significant air entrainment will occur even though the mixing chamber 24 may still be open to the atmosphere.

By combining the primary and secondary streams of water in the manner described above, the flow rate of the water exiting the jet fitting 10 can be increased without increasing the capacity of the pump employed to supply the primary stream of water to the jet fitting 10. Thus, without increasing pump capacity, it has been found that flow rates can be increased as much as 50% or even more. Such increased flow rates result in improved circulation of the water contained in the hydrotherapeutic receptacle, as well as enhanced whirlpool motion and hydromassage effect.

Figure 4:
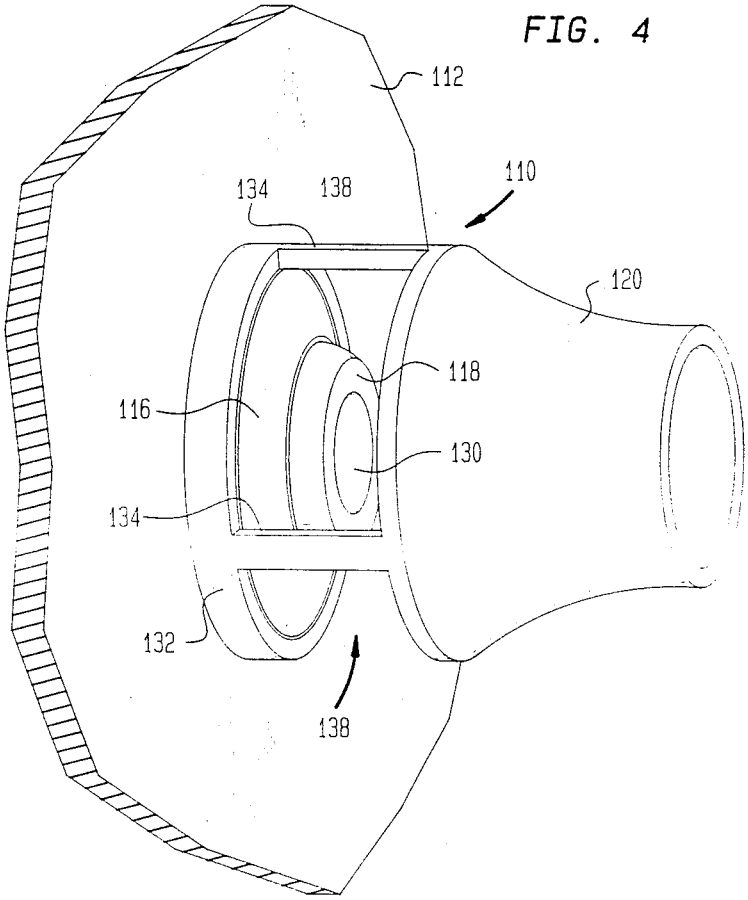
FIG. 4 is a perspective view of a jet fitting constructed in accordance with another exemplary embodiment of the present invention.
Figure 5:
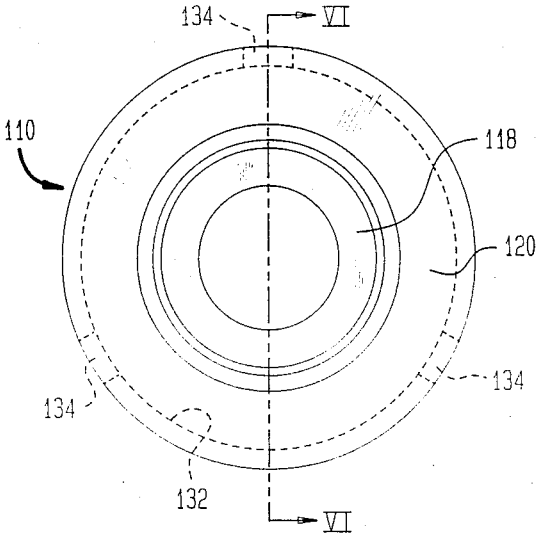
FIG. 5 is a front view of the jet fitting illustrated in FIG. 4.
Figure 6:
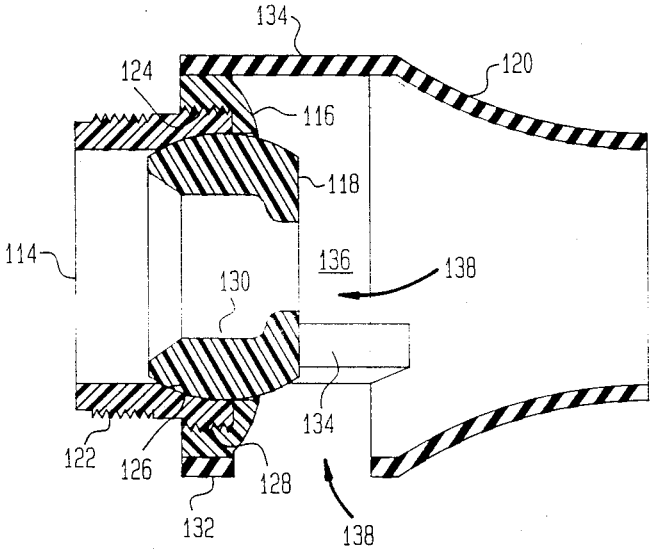
FIG. 6 is a cross-sectional view, taken along section line VI—VI in FIG. 5 and looking in the direction of the arrows, of the jet fitting illustrated in FIG. 5.

With reference now to FIGS. 4–6, a jet fitting 110 is attached to a sidewall 112 of a hydrotherapeutic receptacle, such as a bathtub, spa or therapy tank. The jet fitting 110 includes the following main components: a ball seat 114, a lock ring 116, a directional ball 118 and a nozzle 120, all of which are preferably made out of a suitable polymeric material.

The ball seat 114 has a tubular shape and includes external threads 122 adapted to threadedly engage internal threads (not shown) provided in the sidewall 112 or in an attachment thereto. The ball seat 114 further includes external threads 124 whose function will be described hereinafter. A pocket 126 provided in the ball seat 114 receives the directional ball 118 in such a manner that the directional ball 118 can pivot and rotate freely relative to the ball seat 114.

The lock ring 116 retains the directional ball 118 in the pocket 126 of the ball seat 114 without inhibiting the pivotability and rotatability of the directional ball 118. The lock ring 116 is provided with internal threads 128 adapted to threadedly engage the external threads 124 of the ball seat 114.

The directional ball 118 has a nozzle throat 130 whose function will become evident when the operation of the jet fitting 110 is described hereinafter. For present purposes, it will suffice to point out that the nozzle throat 130 of the directional ball 118 is in substantial alignment with the nozzle 120.

The nozzle 120 has a circular skirt 132 which is cemented or otherwise attached in a preferably permanent manner to the lock ring 116. Posts 134 connect the nozzle 120 to the skirt 122 in such a manner that the nozzle 120 is spaced from the directional ball 118 far enough to form a mixing chamber 136. The posts 134 are also spaced apart from each other so as to form openings 138 whose function will be described hereinafter. As a safety measure, the posts 134 are flexible enough to permit the nozzle 120, which is otherwise stationary, to be deflected in response to physical contact by someone inside the hydrotherapeutic receptacle.

During the operation of the jet fitting 110, a primary stream of water from, for instance, a pump (not shown) is supplied under pressure to the nozzle throat 130 of the directional ball 118 through the ball seat 114. After flowing through the nozzle throat 130 of the directional ball 118, the primary stream of water passes through the mixing chamber 136 on its way to the nozzle 120. The shape of the nozzle throat 130 increases the velocity of the water being discharged into the mixing chamber 136, thereby creating a low pressure condition within the mixing chamber 136. This low pressure condition, in turn, causes a "jet pump" effect which results in a secondary stream of water being sucked into the mixing chamber 136 from the hydrotherapeutic receptacle, the secondary stream of water flowing through the openings 138. The resulting combined stream of water, which is the sum of the primary and secondary streams, flows from the mixing chamber 136 into the nozzle 120 and then into the hydrotherapeutic receptacle, where it creates the desired whirlpool action and hydromassage effect.

By combining the primary and secondary streams in the manner described above, the flow rate of the water exiting the jet fitting 110 can be increased without increasing the capacity of the pump employed to supply the primary stream of water to the jet fitting 110. Such increased flow rates (which, as indicated above, can be 50% greater than normal or even more) result in improved circulation of the water contained in the hydrotherapeutic receptacle, as well as enhanced whirlpool motion and hydromassage effect. To promote the bubbling action of the water discharged from the nozzle 120, the jet fitting 110 may be provided with an air inlet tube (not shown), whereby air is sucked into the mixing chamber 136 along with the secondary stream of water.

It will be understood that the embodiments described herein are merely exemplary and that a person skilled in the art may make many variations and modifications without departing from the spirit and scope of the invention. For instance, the embodiment of FIGS. 4–6 can be provided with an air supply tube similar to the one employed by the embodiment of FIGS. 1–3. All such variations and modifications are intended to be included within the scope of the invention as defined in the appended claims.

We claim:

1. A jet fitting adapted to be mounted on a wall of a hydrotherapeutic receptacle, comprising a housing having a front, a rear, a top and a bottom, said top of said housing including a socket located outside the hydrotherapeutic receptacle and an aperture located in said socket and extending through said top of said housing; a mixing chamber located within said housing; first inlet means located adjacent said front of said housing for providing communication between said mixing chamber and the hydrotherapeutic receptacle; second inlet means located adjacent said rear of said housing for providing communication between said mixing chamber and a source of pressurized water, said second inlet means including accelerating means for increasing the velocity of water being discharged into said mixing chamber from said second inlet means to thereby create a low pressure condition within said mixing chamber which is sufficient to suck water into said mixing chamber through said first inlet means, whereby said mixing chamber also functions as a suction chamber; discharging means for discharging water supplied by said first and second inlet means to said hydrotherapeutic receptacle from said mixing chamber; and supplying means for supplying air to said mixing chamber in response to the low pressure condition created within said mixing chamber, said supplying means including a tube removably mounted in said top of said housing, said tube depending from said top of said housing and extending generally transversely into a water stream being discharged into said mixing chamber from said second inlet means, and said tube having an inlet end releasably received in said socket in said top of said housing and an elongated body sized and shaped so as to slidably extend through said aperture in said top of said housing whereby said tube can be inserted into or withdrawn from said mixing chamber through said top of said housing from outside the hydrotherapeutic receptacle, said body extending from said inlet end to an outlet end located opposite said inlet end and positioned between said accelerating means and said discharging means in the flow path of said water stream, said outlet end having an opening in a bevelled surface located on a side of said outlet end which faces said discharging means and a solid wall portion on an opposite side which faces said second inlet means so as to cause said water stream to flow around said outlet end of said tube in such a manner that the low pressure condition created in said mixing chamber is augmented to thereby enhance the amount of air supplied to said mixing chamber from said opening in said outlet end of said tube, whereby a mixture of water and air is discharged into the hydrotherapeutic receptacle from said mixing chamber.

2. A jet fitting according to claim 1, wherein said second inlet means is positioned on one side of said mixing chamber and wherein said discharging means is positioned on an opposite side of said mixing chamber.

3. A jet fitting according to claim 2, wherein said discharging means includes a nozzle.

4. A jet fitting according to claim 3, wherein said first inlet means is located proximate to said nozzle, whereby water sucked into said mixing chamber through said first inlet means flows adjacent to said nozzle.

5. A jet fitting according to claim 4, wherein said first inlet means substantially surrounds said nozzle.

6. A jet fitting according to claim 4, wherein said first inlet means defines a flow path which runs from the hydrotherapeutic receptacle directly to said mixing chamber.

7. A jet fitting according to claim 6, wherein water is discharged from said discharging means in a first direction and wherein water sucked into said mixing chamber through said first inlet means flows in a second direction which is generally opposite to said first direction.

8. A jet fitting according to claim 7, wherein said flow path is completely contained within said fitting.

9. A jet fitting according to claim 8, wherein said accelerating means includes a nozzle throat having a shape selected so as to constrict the flow of water passing through said second inlet means on its way to said mixing chamber.

10. A jet fitting according to claim 1, wherein said outlet end of said tube is positioned in the center of the water being discharged said mixing chamber from said second inlet means.

11. A jet fitting according to claim 10, wherein said outlet end of said tube is positioned adjacent to said accelerating means of second inlet means.

12. A jet fitting according to claim 1, wherein said tube is open to the atmosphere.

13. A jet fitting according to claim 1, wherein said tube is arranged generally perpendicular relative to said top of said housing.

14. A jet fitting according to claim 1, wherein water under pressure is supplied to said second inlet means by a pump; and wherein said fitting permits the flow rate of water being discharged from said discharging means to be increased without increasing the capacity of the pump.

* * * * *